United States Patent [19]

Kasprzycki et al.

[11] Patent Number: 4,521,981

[45] Date of Patent: Jun. 11, 1985

[54] KEY HOLDER

[75] Inventors: Robert Kasprzycki, Meriden; Chester Fudge, Rockfall, both of Conn.

[73] Assignee: International Key Marketing Incorporated, Bristol, Conn.

[21] Appl. No.: 490,260

[22] Filed: May 2, 1983

[51] Int. Cl.[3] ..... A44C 3/00

[52] U.S. Cl. ..... 40/2 A; 40/17; 40/330

[58] Field of Search ..... 40/16, 17, 2 A, 10 R, 40/330

[56] References Cited

U.S. PATENT DOCUMENTS

| | | | |
|---|---|---|---|
| 297,270 | 4/1884 | Knox | 40/17 |
| 901,838 | 10/1908 | Scotford | 40/2 A |
| 1,175,652 | 3/1916 | Marquette | 40/16 R |
| 2,581,762 | 1/1952 | Hesse | 40/17 |
| 2,629,952 | 3/1953 | Gazan | 40/17 |

*Primary Examiner*—Gene Mancene
*Assistant Examiner*—Wenceslao J. Contreras
*Attorney, Agent, or Firm*—Chapin, Neal & Dempsey

[57] ABSTRACT

The tag for attachment to hotel keys and the like is disclosed herein. The tag includes a base panel and an aperture frame portion defined by upwardly extending sidewall portions and inwardly extending peripheral flange disposed in spaced opposed relation to the outer edge portions of the base panel. A slot is provided through one of the sidewall portions of the flange for insertion and removal of a resiliently flexible card bearing advertising indicia and the like for display within the frame portion of said tag. The undersurface of said flange adjacent to the slot includes a shoulder adapted to engage the outer edge of said card for retaining the card within the frame. The upper surface of the base panel is of stepped construction having a lower lever disposed adjacent to and communicating with the slot and an upper surface level along the portion of the tag opposite the said slot. The step construction of the base panel causes the outer portion of the card to be deflected downwardly and thus tensioned as it is inserted into the frame of the tag and to thereafter release said tension so that the outer edge of the card will snap into engagement with said shoulder for retaining the card within the frame.

2 Claims, 4 Drawing Figures

KEY HOLDER

BACKGROUND OF THE INVENTION

This invention relates to the field of key tags and in particular key tags of improved construction wherein a marketing panel or advertising sheet is removably insertable in the tag used for hotel keys and the like.

Key tags have traditionally been associated with hotel rooms, motel rooms and the like. Since overnight guests are often unaware of both the hotel services (i.e. restaurants, cleaners, bars, etc.) as well as other local service establishments the usually large planar surface of the hotel key tags have, at times, been utilized as an advertising medium.

In recent years, the hotel industry has witnessed an explosive increase in activity with the advent of the modern convention. Large business, professional and political conventions convene on topics ranging from computer seminars to the election of political candidates and each such convention may attract thousands of participants, thus gathering a captive, usually affluent and often sophisticated audience. It would be a tremendous marketing advantage to have one's products intensively advertised to these conventioneers but in an unobtrusive manner. Since most attendees at these conventions gather in large local hotels, they invariably carry their hotel key throughout the duration of the convention. Most hotel keys are affixed to a fairly large tag of some type and the major surfaces of these tags provide ideal spaces for advertising. In effect, each tag constitutes a miniature billboard and it is the use of hotel key tags for advertising which gives impetus to this invention. Indeed, the major hotels may be able to lease out such key tag advertising space for product promotion and thus generate a new source of income without any substantial investment, except for changing its key tags.

One advertising key tag is shown in U.S. Pat. No. 297,270 which discloses a two-piece key holder wherein advertising sheets or cards are fitted and retained between two interlocking plates. Another key tag of this type is shown in U.S. Pat. No. 1,178,236, whereby advertising cards are locked into a key tag by bending the hook of the key link into a desired shape. The cards are removed therefrom by use of a tool to unbend the hook and remove it from the eye of the tag. There have been several other patents which disclose key tags with interchangeable advertising cards and in this regard, reference is made to U.S. Pat. Nos. 311,331—1,714,421—2,297,285—3,094,799 and 4,187,628 which show various means for the insertion, retention and display of advertising materials on key tags.

While U.S. Pat. Nos. 1,714,421 and 2,297,285 show key tags having slidably insertable cards, they nevertheless lack simple but effective retention mechanisms which can be economically formed in simple but effective construction having a contemporary and aesthetically pleasing appearance. Although related to a different art, the belt buckle disclosed in U.S. Pat. No. 3,969,836 shows a slidable insert having either an arcuate configuration or requiring a separate keeper plate 48.

The principal object of the present invention is to provide a key tag for a removably-insertable marketing or advertising insert sheet or card which is of simple and economical construction having improved operational features while providing a contemporary appearance appealing to hotel guests and others.

Another object of this invention is to provide a key tag of the above type having constructional characteristics which include simple, yet effective retention means to hold the advertising insert securely in place on the tag but which enables easy removal by the hotel for replacement from time-to-time with other advertising inserts.

The above and other objects and advantages of this invention will be more readily apparent from a reading of the following description taken in conjunction with the following drawings in which.

Figure 1:
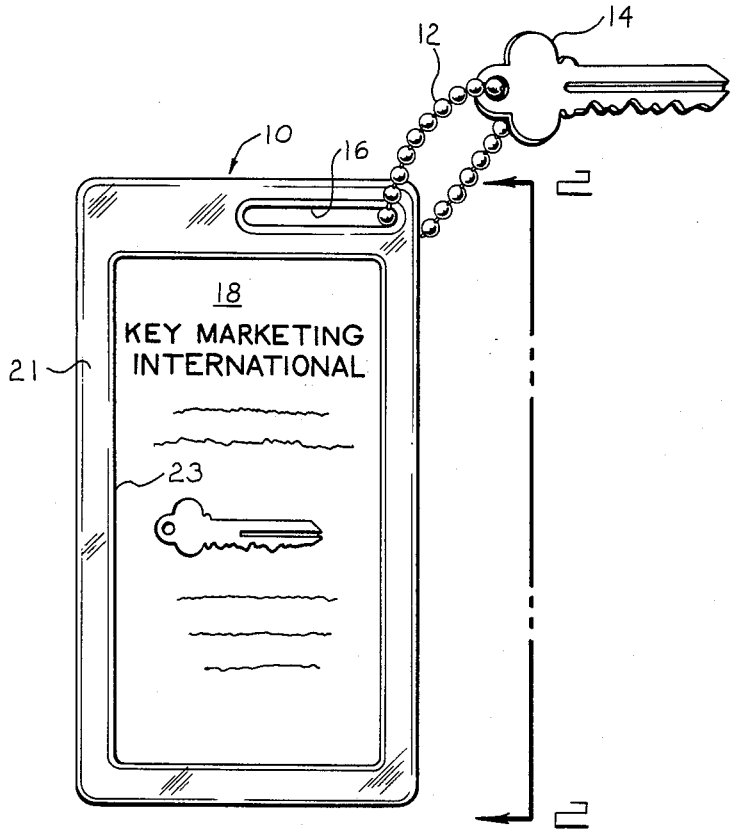
FIG. 1 is a front elevational view of a key tag of the type embodying this invention shown with an advertising sheet inserted therein.
Figure 2:
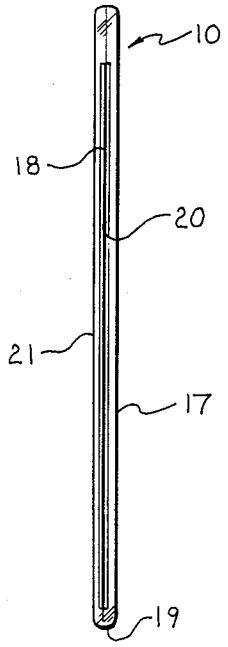
FIG. 2 is a side elevational view of the key tag of FIG. 1 viewed from line 2—2.
Figure 3:
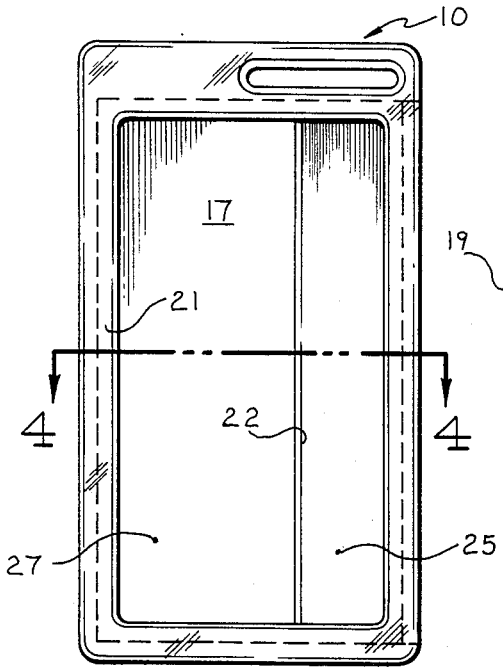
FIG. 3 is a front elevational view of the key tag of FIG. 1 with the advertising sheet removed.

Referring in detail to the drawing in FIG. 1, is shown a key tag 10 embodying the present invention. The key tag 10 may be attached by any conventional means such as a conventional key chain 12 looped through the head of a key 14 and an opening 16 in the upper corner of the tag.

The tag 10 comprises a generally flat plate or disk having a base panel 17 an outer edge frame portion, including upwardly extending peripheral edge portion 19 and inwardly extending rim or flange 21. The inner edge of the flange 21 defines a frame aperture 23 through which the outer surface indicia of an advertising insert sheet or card 18 may be viewed. The peripheral flange 21 holds the edges of the card thereunder and frames the advertising message printed on the card to focus attention on the same. The tag may be formed of any suitable material, such as a synthetic plastic material of suitable durability and appearance. Preferably, the tag is formed of resiliently flexible, light weight material and may be extruded or injection molded in one or two piece construction.

The tag 10 is preferably of rectangular configuration and its dimensions are advantageously made slightly larger than the dimensions of the typical business card so that a company business card may be fitted into the key tag frame, such as illustrated in FIG. 1.

Figure 4:
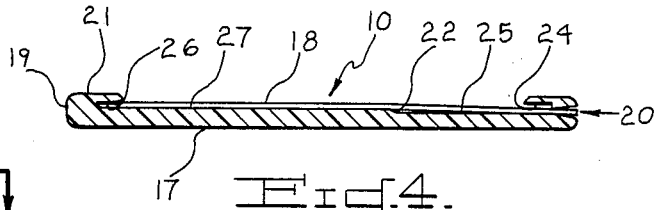
FIG. 4 is a sectional view on an enlarged scale, taken along line 4—4 of FIG. 1.

For ready insertion and removal of an advertising card 18, such as a plastic or cardboard sheet material, one of the larger side edges of the tag is provided with an access opening or slot 20, as best illustrated in FIG. 4. As shown, the length of slot 20 is made slightly greater than the longer dimension of the advertising card which the tag is adapted to receive. The inner edges of the slot are preferably flared outwardly for ease of inserting the leading edge of the card into the frame portion of the tag. A shoulder or ledge 24 (FIG. 4) is provided at the upper, inner edge of slot 20 which is adapted to receive the outer side edge of the advertising card for retaining the card within the frame portion of the key tag.

The upper surface of the base panel 17 includes a longitudinally extending step or ridge 22 defining a lower outer base portion 25 of lesser height or thickness than the remainder of the base which is of greater height or thickness as at 27. The horizontal dimension or width of the lower base 25 is substantially less than that of portion 27. The slot 20 opens through the sidewall portion 19 of the frame at the same level as the lower base portion 25. This stepped base construction serves to cause the outer edge portion of a resiliently flexible advertising card, sheet or panel of standard size and thickness to recoil upwardly into locking engagement with the shoulder 24 of the frame. Preferably, the card stock which the tag 10 is adapted to display may be in the range of 0.006 inch to 0.012 inch. Of course, it will be realized that the concept of this invention is equally well adapted for use with any relatively resilient materials such as fiberboard, plastic or the like, which when bowed or tensioned have a tendency to spring back to their normal planar configuration.

When a marketing card 18 is fitted through entry slot 20, its leading edge portion contacts and thereafter travels or is ramped upwardly over step 22 and then its leading edge slides over the wider, raised portion 27 of the base 17. This action causes the outer edge portion of the card to be deflected slightly or tensioned as shown in FIG. 4. As the panel 18 is further slid into the frame portion of the tag 10, the leading edge of the card will fit under the flange 21 opposite entry slot 20. Simultaneously, the shorter, outer edge portion of the relatively resilient card will be released by the upper surface of the slot 20 and the card in resuming its normal flat state will snap upwardly so that its outer edge will engage the shoulder or retainer ledge 24. The ledge 24 serves to retain and hold the advertising card within the frame under all normal handling.

In order to retract or remove the card 18, its outer edge portion, which spans the surface 25, need merely be deflected downwardly while at the same time the card is shifted outwardly toward the slot 20. The ability to readily interchange advertising panels is an important factor in inducing hotels adopt these advertising display tags. Since hotels often service numerous conventions at very close intervals, it will be necessary to change over the advertising and/or promotional cards carried in all the key tags of successive groups of conventioneers. The quick and easy insertion and removal of advertising material is an important consideration for a hotel to utilize key holder tags of the type embodying this invention.

The key tag 10 of the present invention may be inexpensively molded or extruded from any suitable plastic material in a one-piece or two-piece construction. In a two-piece construction, the base panel 17 would form one part of the tag and frame would form the second portion. These parts may be bonded together by any suitable adhesive or other bonding technique. Any desirable finish (i.e. smooth or rough) may be utilized to perfect a decorative and contemporary design. This stylized key tag, in combination with a pertinent marketing panel, can be a valuable marketing device for convention exhibitors, local merchants and hotel owners.

It should be noted that the key tags with insertable marketing sheets or panels may also be advantageously employed in other fields where keys are used. For example, automobile rental agencies may find the key tags of the present invention to be well suited for their needs.

Having thus described this invention, what is claimed is:

1. Key tags for hotel keys and the like for use with an indicia bearing insert of resilient flexible sheet material, said tag comprising a base panel and an apertured frame portion with a slot through at least one edge portion of the frame for receiving said insert therethrough, said tag including a retaining surface for engaging the insert to retain the same within said frame, said base panel being of stepped construction having a lower level disposed adjacent said slot and an upper level adjacent the opposite edge of said tag, said slot opening through said frame at about the same height as the lower level of the stepped base panel whereby the resilient insert is tensioned as it is being inserted through said slot and its leading edge portion extends over the upper level of said base, the tension being released when said insert is fully inserted into said frame so that it will flex into engagement with said retaining surface.

2. Key tag for hotel keys and the like as set forth in claim 1 in which said flange defines a peripheral frame spaced from the underlying edge portion of the base panel, said retaining surface comprising an edge on the underside of said flange adjacent said slot and disposed along the upper surface thereof, said tag being dimensioned to receive said insert within said frame with the outer edges of the insert disposed between said flange and base panel, said slot being defined in part by the lower level of said base panel and the opposed under surface of said flange.

* * * * *